US005640908A

United States Patent [19]

Schaede

[11] Patent Number: 5,640,908

[45] Date of Patent: Jun. 24, 1997

[54] CHAIN SHEET DELIVERY SYSTEM FOR A ROTARY PRINTING PRESS

[75] Inventor: Johannes Georg Schaede, Würburg, Germany

[73] Assignee: Koenig & Bauer-Albert Aktiengesellschaft, Wurzburg, Germany

[21] Appl. No.: 548,100

[22] Filed: Oct. 25, 1995

[30] Foreign Application Priority Data

Oct. 26, 1994 [DE] Germany ..... 44 38 263.4

[51] Int. Cl.[6] ..... B41F 1/30

[52] U.S. Cl. ..... 101/484; 101/232; 101/246; 101/409; 271/204

[58] Field of Search ..... 101/408, 409, 101/410, 246, 232, 240, 484, 485; 271/204, 206, 277, 287, 291, 296

[56] References Cited

U.S. PATENT DOCUMENTS

| | | | |
|---|---|---|---|
| 2,130,841 | 9/1938 | Eckhard | 101/408 |
| 3,563,175 | 2/1971 | Torresen | 101/322 |
| 4,210,078 | 7/1980 | Greiner et al. | 101/240 |
| 4,413,562 | 11/1983 | Fischer | 101/408 |
| 5,390,600 | 2/1995 | Thünker | 101/408 |
| 5,477,780 | 12/1995 | Keller | 101/408 |

FOREIGN PATENT DOCUMENTS

| | | | |
|---|---|---|---|
| 220641 | 4/1962 | Austria . | |
| 1 017 180 | 10/1957 | Germany . | |
| 1 176 672 | 4/1965 | Germany . | |
| 2323432 | 5/1973 | Germany | 271/204 |

*Primary Examiner*—Christopher A. Bennett
*Attorney, Agent, or Firm*—Jones, Tullar & Cooper, P.C.

[57] ABSTRACT

A method and apparatus that uses chain delivery system to deliver printed sheets to one of two sheet stacks is disclosed. The sheets are grasped by chain gripper systems and are transported along an upper chain strand. A transfer cylinder is positioned in the path of sheet travel between the two sheet stacks. Sheets destined for the second sheet stack are removed from the upper chain strand by the transfer cylinder and delivered to the second sheet stack by a lower chain strand.

10 Claims, 2 Drawing Sheets

CHAIN SHEET DELIVERY SYSTEM FOR A ROTARY PRINTING PRESS

FIELD OF THE INVENTION

The present invention is directed generally to a chain sheet delivery system for a rotary printing press. More particularly, the present invention is directed to a chain sheet delivery system usable to selectively deliver printed sheets to one of at least two sheet stacks. Most specifically, the present invention is directed to a method and apparatus for transporting sheets in a chain sheet delivery system of a rotary printing press and for selectively delivering the sheets to one of two sheet stacks. The two sheet stacks are disposed one after the other in the sheet transport direction of the chain sheet delivery system. Sheets which are delivered to the second or downstream sheet stack are removed from an upper strand of the chain sheet delivery system upstream of the first sheet stack by a transfer cylinder located intermediate the two sheet stacks, and these removed sheets are then resecured to a lower strand of the chain sheet delivery system. The sheets delivered to the second sheet stack bypass the first sheet stack.

DESCRIPTION OF THE PRIOR ART

It is generally known in the prior art to use chain sheet delivery systems in rotary printing presses to transport printed sheets to sheet stacks. These chain sheet delivery systems typically utilize spaced chain wheels and parallel chains, which are connected by axially extending gripper bars, to grip the leading edges of sheets and to transport these sheets. One prior art chain sheet delivery arrangement is shown in German Patent No. 1 176 672 which discloses a chain sheet delivery system in which sheets are transported with their most recently printed side facing down. These sheets are placed on a sheet stack with the last printed side facing up. This is accomplished by turning the sheet through 180° before placing the sheet on the sheet stack.

One limitation of the prior art chain sheet delivery systems has been their inability to delivery printed sheets selectively to one of several sheet stacks. If it is desired to have the capability of accomplishing this type of delivery of printed sheets to one of several sheet stacks, the prior art has required either two chain sheet delivery systems or has required that the sheets to be delivered to the second sheet stack must be moved past the first sheet stack. Both of these alternatives have several drawbacks. The provision of two chain sheet delivery systems clearly results in increased costs and additional equipment. The second alternative is apt to cause damage to the sheets deposited in the first sheet stack as the sheets being deposited in the second sheet stack pass over the first stack.

It is clear that a need exists for a chain sheet delivery system that overcomes the limitations of the prior art. The chain sheet delivery system for a rotary printing press in accordance with the present invention provides such a device and is a significant improvement over the prior art.

SUMMARY OF THE INVENTION

It is an object of the present invention to provide a chain sheet delivery system for a rotary printing press.

Another object of the present invention is to provide a chain sheet delivery system usable to selectively delivery printed sheets to one of two sheet stacks.

A further object of the present invention is to provide a method and apparatus for transporting sheets in a chain sheet delivery system of a rotary printing press for selectively delivering the sheets to one of two sheet stacks.

Yet another object of the present invention is to provide a chain sheet delivery system for delivery of sheets with a printed side up to a second sheet stack.

Even a further object of the present invention is to provide a chain sheet delivery system which uses a pair of delivery chains that are common to both sheet stacks.

Still yet a further object of the present invention is to provide a chain sheet delivery system which requires no switchable guide devices for transporting the sheets over the first stack to the second stack.

As will be discussed in detail in the description of the preferred embodiment which is presented subsequently, the chain sheet delivery system in accordance with the present invention transports the sheets between spaced chains that are joined by axially extending gripper strips. The two chains form a closed path. First and second sheet stacks are situated along the path of travel of the chains. A transfer cylinder is located within this closed chain path and is intermediate the two sheet stacks. Printed sheets being transported by the chain sheet delivery system and which are intended for delivery to the second sheet stack, are removed from the delivery chains upstream of the first sheet stack by the transfer cylinder. These sheets are carried by the transfer cylinder from their point of detachment from the chains upstream of the first sheet stack to a point of sheet reattachment to the chains. This reattachment point is situated downstream of the first sheet stack but upstream of the second sheet stack, all in the direction of travel of the chains in the chain sheet delivery system.

The chain sheet delivery system of the present invention overcomes the limitations of the prior art in several major aspects. The chain sheet delivery system does not require any switchable guide devices or duplicate chain wheels and chains to accomplish the delivery of the printed sheets to the selected sheet stack. Because of the employment of common delivery chains for the several sheet stacks, the duplicate chain wheels required for the individual chains used to deliver sheets to the several sheet stacks, together with their associated drive means, are not required. The chain sheet delivery system in accordance with the present invention is thus much more cost-effective than were the prior art devices.

The printed sheets to be transported to the second or downstream sheet stack are removed from the chain sheet delivery system by the transfer cylinder upstream of the first sheet stack and are reattached to the delivery chain from the transfer cylinder downstream of the first sheet stack and upstream of the second sheet stack. This means that the printed sheets destined for the second sheet stacks are not moved over the first sheet stack. Thus it is impossible to damage the sheets on the first sheet stack by having the sheets bound for the second sheet stack moving over the first sheet stack.

The chain sheet delivery system for a rotary printing press in accordance with the present invention overcomes the limitations of the prior art. This system is a substantial advance in the art.

BRIEF DESCRIPTION OF THE DRAWINGS

While the novel features of the chain sheet delivery system for a rotary printing press in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
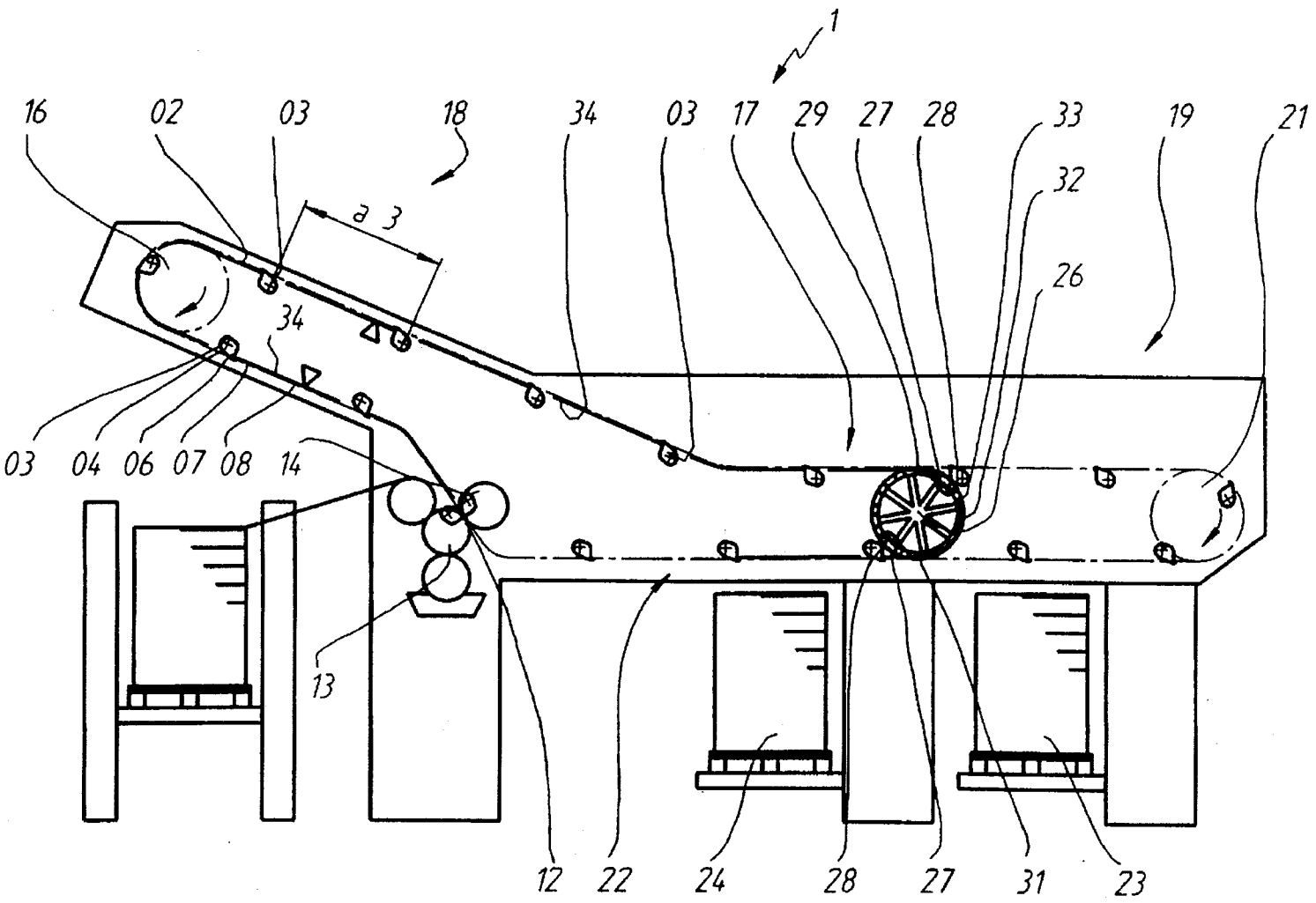
FIG. 1 is a schematic side elevation view of a preferred embodiment of a chain sheet delivery system in accordance with the present invention.

Referring initially primarily to FIG. 1, there may be seen, generally at 1, a preferred embodiment of a chain sheet delivery system for a rotary printing press in accordance with the present invention. The chain sheet delivery system 1 is depicted in use with a sheet-fed rotogravure printing press. However, it will be understood that the chain sheet delivery system 1 could also be used with other types of printing presses. The schematic depiction of the chain sheet delivery system 1 shows only one side of the system and the press. It will be understood that this system 1 is symmetrical about a longitudinal center axis of the rotary printing press. Thus only one side of the system 1 is depicted in FIG. 1 and will be discussed hereinafter, it being understood that the second side of the system is the same as the first.

As may be seen in FIG. 1, an endless delivery chain 2 is provided with spaced chain gripper systems 3. These chain gripper systems 3 are separated from each other along the length of chain 2 at a spacing "a3" of, for example, 940 mm, which spacing is typically greater than a length of sheets 8 being conveyed by the chain sheet delivery system 1. The total length "12" of the delivery chain 2 is a whole number multiple N of the spacing "a3" between the chain gripper system 3. In other words, the total chain length 12=N×"a3".

Figure 2:
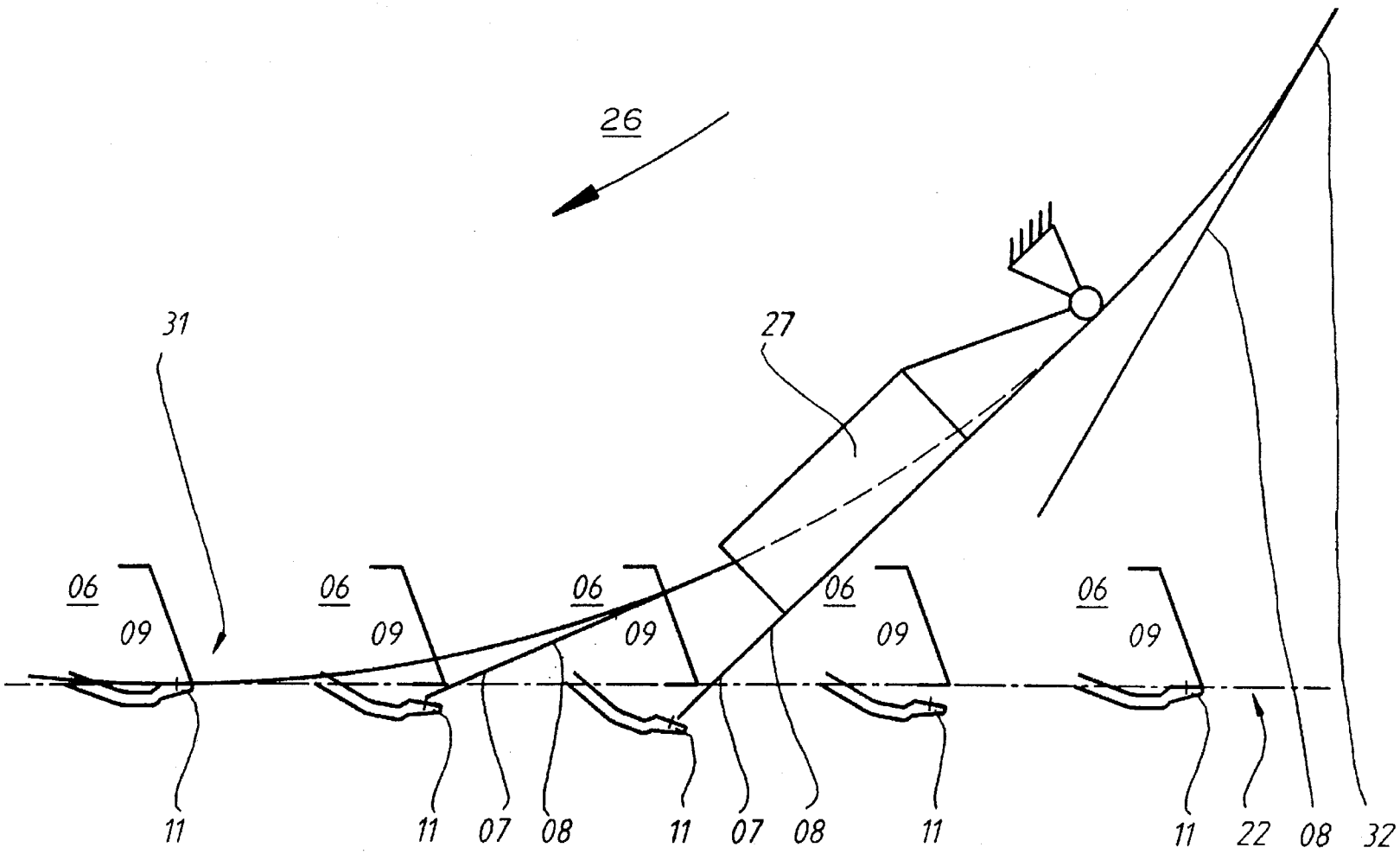
FIG. 2 is an enlarged schematic depiction of a transport point between a transfer cylinder and the chain sheet delivery of the present invention.

Each of the chain gripper systems 3 essentially includes a cross arm 4 which extends, in the axial direction of the various press cylinders and rollers, between the two spaced endless chains 2. Each cross arm 4 carries a plurality of sheet grippers 6 which may be, for example, clamping grippers. The grippers 6 of each cross bar 4 of each chain gripper system 3 grip a leading edge 7 of a printed sheet 8. As may be seen more clearly in FIG. 2 each gripper 6 includes gripper bases 9 and gripper tips 11 which cooperate to grip and hold the leading or front edge 7 of each sheet 8.

Again referring to FIG. 1, a sheet 8 from a stack of unprinted sheets, is conveyed to a sheet guiding cylinder, generally at 13, by any conventional device. This sheet guiding cylinder 13 may be, for example, a printing cylinder 13 which is part of a sheet-fed rotary printing press. A chain wheel 14 is situated adjacent the printing cylinder 13 and forms a first sheet transfer point 12. The chain wheel 14 guides the endless delivery chain 2 in the area of the first sheet transfer point 12. It is at this point where a printed sheet 8 is delivered to a chain gripper system 3 of the endless delivery chain 2.

The endless delivery chain 2 extends from the first sheet transfer point 12 and passes around a second chain wheel 16. This second chain wheel 16 reverses the direction of travel of the endless delivery chain 2 and directs the chain 2 along an elevated travel path as an upper chain segment 17. The printed sheets 8 are carried along the upper chain segment 17 by the gripper systems 3 with their most recently printed sides facing downwardly. From the second chain wheel 16, which is located at the upper left portion of the chain delivery system 1, as viewed in FIG. 1, the endless delivery chain 2 runs toward the right and toward the right side portion of the chain sheet delivery system 1. At the right side of the system 1 there is situated a reversing chain wheel 21. The endless delivery chains 2 are again turned through generally 180° and form a lower chain strand 22. It can thus be seen that the endless delivery chain 2 forms a closed loop which is bounded at its ends by the second chain wheel 16 and the reversing chain wheel 21, and further that the endless path is primarily comprised of the upper chain strand 17 and the lower chain strand 22. In the upper chain strand 17 the chain gripper systems 3 are moving from left to right, as viewed in FIG. 1 whereas in the lower chain strand 22 the gripper systems 3 are moving from right to left.

As may also be seen in FIG. 1, first and second sheet stacks 23 and 24 respectively, are positioned beneath the lower chain strand 22. The first sheet stack 23 is the upstream sheet stack in the direction of travel of the lower chain strand 22 while the second sheet stack 24 is the downstream sheet stack. The particular structure of each of these sheet stacks 23 and 24 is not of significance to the present invention.

The chain sheet delivery system 1 of the present invention includes a transfer cylinder 26 which, as may be seen in FIG. 1, is situated within the closed loop path formed by the endless delivery chains 2 and intermediate the two spaced sheet stacks 23 and 24. This transfer cylinder 26 operates in cooperation with the upper and lower chain strands 17 and 22, respectively, and is provided with one or a plurality of sheet gripper systems, generally at 27 spaced evenly about its circumferential surface. The circumference "u26" of the transfer cylinder 26 is a whole number multiple N of the spacing "a3" between the gripper systems 3 on the endless delivery chains; i.e. "u26"=N×"a3". The transfer cylinder 26 is provided with several axially extending peripheral U-shaped recesses 28 which correspond in shape and spacing to the shape and spacing of the chain gripper systems 3. The chain gripper system 3 will fit into these recesses 28 as the upper and lower chains strands 17 and 22 pass the transfer cylinder 26. In the course of sheet transfer from the chain gripper systems 3 to the transfer cylinder gripper systems 27, the gripper bases 9 of the grippers 6 of the chain gripper systems 3 are on the same level as the gripper systems 27 of the transfer cylinder 26. The upper and lower chain strands 17 and 22 are tangent to the peripheral surface of the transfer cylinder 26 and thus form upper and lower transfer points 29 and 31, respectively.

If the circumference "u26" of the transfer cylinder 26 is an even number multiple of the spacing distance "a3" between the chain gripper systems 3, a partial length "lT2" of the delivery chain 2 between the transfer points 29 or 31 and the reversing wheel 21 is a whole number multiple N of the spacing a3; i.e. "lT2"=N×"a3". Alternatively, if the circumference "u26" of the transfer cylinder 26 is an odd number multiple of the spacing distance "a3", the partial length "lT2" of the delivery chain 2 between the transfer points 29 or 31 and the reversing chain wheel 21 is a whole number multiple N of the sum of the spacing distance "a3" plus one half of the spacing distance "a3"; i.e. "lT2"=N× "a3"+0.5×"a3".

In the preferred embodiment of the transfer cylinder 26, as depicted in FIG. 1, the cylinder 26 is provided with first and second diametrically opposed gripper systems 27 and with two corresponding U-shaped recesses 28 that will receive the chain gripper systems 3. Thus the circumference "U26" of the transfer cylinder 26 corresponds to twice the spacing "a3". The reversing chain wheel 21 has a circumference "u21" which is also twice the spacing "a3" of the chain gripper systems 3.

The gripper systems 27 of the transfer cylinder 26 are, in the preferred embodiment, provided as suction gripper elements 27 of generally known construction and operation. Suitable clamping grippers could also be used as the gripper systems 27. Alternatively, these grippers 27 could be generally conventional gripper points. In addition to using suction grippers 27 as the gripper systems on the transfer cylinders 26 which will grip and hold the front or the leading edge 7 of each sheet 8, it is also desirable to provide switchable suction elements, generally at 33, on the entire peripheral surface of the transfer cylinder 26. This means that the transfer cylinder 26 is embodied as a suction cylinder. Each of the gripper systems 27 on the transfer cylinder 26, which are used to engage the leading edges or end 7 of a sheet 8, can be moved out away from the surface 32 of the transfer cylinder 26 and can thereby lift the leading edge 7 of a sheet 8 off the surface 32 of the transfer cylinder 26. This elevation of each of the transfer cylinder sheet leading edge grippers 27 out of the surface 32 of the transfer cylinder 26 can be controlled, for example, by suitable cams which are not specifically shown.

In operation of the chain sheet delivery system in accordance with the present invention, a sheet 8 is printed by the rotary printing press, which includes the printing cylinder 13. The printed sheet 8 is delivered to the sheet transfer point 12 where the printing cylinder 13 and the lower chain strand 22 intersect. At this point, the leading end 7 of the sheet 8 is gripped by the chain gripper system 3 in such a manner that the most recently printed side 34 is facing upwardly toward the upper chain strand 17. The sheet 8, which is grasped at its leading edge 7, is transported by the endless chains 2 and the chain gripper system 3 around the second chain wheel 16 where the orientation of the sheet 8 will be reversed so that the last printed side 34 now faces down toward the lower chain strand 22. The sheet is transported along by the upper chain strand 17 until it arrives at the transfer cylinder 26. If the sheet 8 is to be deposited on the first sheet stack 23; i.e. on the sheet stack upstream of the transfer cylinder 26 in the direction of travel of the lower chain strand 22, the sheet 8 will continue along on the upper chains strand 17 and will pass around the reversing chain wheel 21. The chain gripper system 3 will remain closed and the suction gripper systems 27 on the transfer cylinder 26 will remain deactivated. As the sheet 8 passes around the reversing chain wheel 21, the orientation of the sheet 8 again reverses so that the last printed side 34 again faces upwardly toward the upper chain strand 17. As the sheet 8 approaches the first or upstream sheet stack 23, the chain gripper system 3 is operated by a generally known sheet depositing system, that is not specifically shown, so that the grippers 6 of the chain gripper system 3 will release the leading edge 7 of the sheet 8. The now released sheet 8 will be deposited on the top of the first or upstream sheet stack 23.

If it is desired to deposit the sheet 8 on the second or downstream sheet stack 24, the sheet 8 is carried by the chain gripper system 3 to the upper transfer point 29 at the point of tangency of the upper chain strand 17 with the transfer cylinder 26. At this upper transfer point 29, the leading edge 7 of sheet 8 is taken over by the gripper system 27 of the transfer cylinder 26. In the preferred embodiment in which the gripper system 27 is a suction gripper, vacuum is applied to the gripper system 27. As soon as the gripper system 27 has engaged the leading edge 7 of the sheet 8, the grippers 6 of the chain gripper system 3 release their grip on the leading edge 7. The sheet is transported around through generally 180° by the transfer cylinder 26 and is carried from the upper chain strand 17 to the second or lower transfer point 31 at the point of tangency of the lower chain strand 22 with the circumference of the transfer cylinder 26. As may be seen most clearly in FIG. 2, approximately 30° before the gripper system 27 arrives at the lower transfer point 31, it will move out of the surface 32 of the transfer cylinder 26. As the chain gripper system 3 on the lower chain strand 22 approaches the lower transfer point 31, the grippers 6 will open so that they can receive the leading end 7 of the sheet 8. During the course of the continued rotational movement of the transfer cylinder 26, the gripper member 27 of the transfer cylinder 26 will be pivoted back into the surface 32 of the transfer cylinder 26. The leading edge 7 of the sheet 8 is delivered to the space between the gripper base 9 and the gripper tip 11 of the grippers 6 of the chain gripper system 3. The grippers 6 on the chain gripper system 3 are then closed and will have accomplished the secure grasping of the sheet 8 at the lower transfer point 31. The sheet 8 is now transported by the lower chain strand 22 to the second or downstream sheet stack 24 without having passed over or by the first or upstream sheet stack 23.

As the chain gripper system 3 approaches the second or downstream sheet stack 24, the grippers 6 on the chain gripper system 3 are opened. A sheet depositing system, that is generally the same as the sheet depositing system which is provided for the first sheet stack 23, is provided for operation with the second sheet stack 24. This sheet depositing system will deposit the sheet 8 on the second sheet stack 24 once it has been released from the chain gripper system 3 on the lower chain strand 22.

While a preferred embodiment of a chain strand delivery system for a rotary printing press in accordance with the present invention has been set forth fully and completely hereinabove, it will be apparent to one of skill in the art that a number of changes in, for example, the type of rotary press used, the drive assemblies for the endless delivery chains, the type of paper printed and the like could be made without departing from the true spirit and scope of the present invention which is accordingly to be limited only by the following claims.

What is claimed is:

1. A method for transporting sheets in a chain sheet delivery system of a rotary printing press including:

providing an endless delivery chain having spaced upper and lower chain strands;

positioning a plurality of chain gripper systems on said endless delivery chain;

using said chain gripper systems to grip printed sheets having a last printed side with said last printed side facing downwardly as said sheets are traveling along said upper chain strand;

locating first and second sheet stacks along a path of travel of said lower chain strand;

situating a selectively operable gripper member intermediate said upper and lower chain strands and between, in the direction of travel of said lower chain strand, said first and second sheet stacks; and operating said selectively operable gripper member for removing a printed sheet from said upper chain strand and for depositing a printed sheet for delivery in a last printed side up orientation to said second sheet stack.

2. The method of claim 1 further including transferring a printed sheet from said selectively operable gripper member to a chain gripper system of said lower chain strand of said endless delivery chain.

3. A chain sheet delivery system for a rotary printing press comprising:

an endless delivery chain including an upper chain strand and a lower chain strand;

a plurality of chain gripper systems spaced along said endless delivery chain;

first and second sheet stacks positioned adjacent said lower chain strand; and selectively operable gripper members situated between said upper and lower chain strands, downstream, in a direction of travel of said lower chain strand, of said first sheet stack and upstream of said second sheet stack, said gripper members being selectively operable to accept sheets from said chain gripper system on said upper chain strand and to transfer sheets to said chain gripper systems on said lower chain strand.

4. The system of claim 3 further including a transfer cylinder situated between said upper and lower chain strands and wherein said gripper members are disposed on said transfer cylinder.

5. The system of claim 4 wherein said transfer cylinder is a suction cylinder and further wherein said gripper members are suction grippers.

6. The system of claim 4 wherein said gripper members are shiftable out of a surface of said transfer cylinder.

7. The system of claim 4 wherein said transfer cylinder has a circumferential length which is a whole number multiple of a spacing distance between ones of said plurality of chain gripper systems.

8. The system of claim 7 wherein said whole number multiple is 2.

9. The system of claim 7 further including a reversing chain wheel located before, in a direction of travel of said lower chain strand, said first sheet stack and wherein said whole number multiple is an even number, said reversing chain wheel being located at a partial length from said transfer cylinder which is a whole number multiple of said spacing distance of said plurality of chain gripper systems.

10. The system of claim 7 further including a reversing chain wheel located before, in a direction of travel of said lower chain strand, said first sheet stack and wherein said whole number multiple is an odd number, said reversing chain wheel being located at a partial length from said transfer cylinder which is a whole number multiple of said spacing distance of said plurality of chain gripper systems plus one half of said spacing distance.

* * * * *